United States Patent [19]

Labe, III

[11] 4,074,827

[45] Feb. 21, 1978

[54] MULTI-PURPOSE CLOSURE FOR CONTAINERS

[76] Inventor: Jacob Labe, III, 421 Ashbourne Road, Elkins Park, Pa. 19117

[21] Appl. No.: 719,303

[22] Filed: Aug. 31, 1976

[51] Int. Cl.[2] ..... B65D 77/20

[52] U.S. Cl. ..... 220/23; 206/217; 215/1 A; 220/256; 229/7 S; 229/43

[58] Field of Search ..... 229/43, 1.5 B, 7 S; 206/216, 217, 230; 215/1 A; 220/23, 256, 306; 426/115, 84, 124, 130

[56] References Cited

U.S. PATENT DOCUMENTS

| | | | |
|---|---|---|---|
| 2,120,403 | 6/1938 | Godfrey | 220/23 |
| 2,617,559 | 11/1952 | Van Der Spek | 215/1 A |
| 3,085,709 | 4/1963 | Klein | 220/23 |
| 3,095,109 | 6/1963 | Exton | 220/23 |
| 3,112,824 | 12/1963 | Lemelson | 220/23 |
| 3,269,734 | 8/1966 | Ottofy | 206/232 |
| 3,514,029 | 5/1970 | Powell | 220/23 |
| 3,557,995 | 1/1971 | Mirasol, Jr. | 229/43 |
| 3,567,064 | 3/1971 | Churan | 220/256 |
| 3,655,096 | 4/1972 | Easter | 206/222 |
| 3,734,276 | 5/1973 | Bank | 206/232 |
| 3,779,372 | 12/1973 | de Lloreh | 426/115 |
| 3,792,798 | 2/1974 | Chang | 215/1 A |
| 3,796,002 | 3/1974 | Katsuda | 220/256 |
| 3,822,030 | 7/1974 | Tanzer | 229/7 S |
| 3,874,554 | 4/1975 | Chang | 206/217 |
| 3,921,801 | 11/1975 | Sway | 220/256 |
| 3,938,686 | 2/1976 | Milligan et al. | 229/43 |
| 3,941,275 | 3/1976 | Simmons | 220/256 |

FOREIGN PATENT DOCUMENTS

| | | | |
|---|---|---|---|
| 1,558,624 | 1/1969 | France | 206/216 |

*Primary Examiner*—William Price
*Assistant Examiner*—Bruce H. Bernstein
*Attorney, Agent, or Firm*—Caesar, Rivise, Bernstein & Cohen, Ltd.

[57] ABSTRACT

A closure for a container. The closure includes a base member having a central portion and a peripheral flange and a cover member also having a central portion and a peripheral flange. The cover member is adapted to be releasably secured to the base member such that when secured a cavity is formed between the respective members. The cavity is adapted for holding products, e.g., premiums or advertising material therein. Alternatively, a game or amusement device can be disposed within the cavity. To that end, in one embodiment of the invention the base member includes at least one recess and at least one ball adapted to fit within the recess to provide a game of skill. Means are provided, such as a cross-cut in the closure to enable a straw to be extended therethrough and into the container with the closure in place. A marginal portion is provided in one embodiment on the flange of the cover member to facilitate the separation of the cover member from the base member.

2 Claims, 8 Drawing Figures

MULTI-PURPOSE CLOSURE FOR CONTAINERS

This invention relates generally to closures for containers and more particularly to closures that form toys or amusement devices in themselves or contain and dispense useful products or services.

Heretofore prior art containers for closures have generally been formed of a single piece of plastic, paper or other material and as a continuous surface enclosing the volume within the container. Various closures are formed with low relief and/or printed designs. Some closures may include die-cuts of different construction to permit penetration of the closure by a drinking straw. Other closures may be pierced to permit steam to escape in applications wherein the contents of the container is hot.

While all of the prior art container closures are operative and functional for sealing the container, such closures perform no other function. Since the closure devices of the prior art perform no function other than as a mere cap or cover they are subsequently disposed of when the container is either initially opened or the contents of the container are consumed.

In view of the lack of secondary utility of prior art closures, the disposal of such closures creates an unnecessary cost to the consumer. It also creates a high potential for littering and visual pollution by necessitating custodial costs for municipalities or property owners.

This disadvantage is particularly significant in mass feeding or fast food establishment wherein such closures are commonly utilized.

Accordingly, it is a general object of the instant invention to provide a closure which, while functional to seal the mouth of a container, also provides secondary utility.

It is a further object of this invention to provide a closure for a container including a cavity therein for containing or dispensing useful products or services.

It is still a further object of this invention to provide a closure for a container, which closure serves as an amusement device.

It is yet a further object of this invention to provide a closure for a container having a cavity forming an amusement device or for holding some product therein and which closure is readily openable to provide access to said product.

These and other objects of the instant invention are achieved by providing a closure for the mouth of a container comprising a base member having a central portion and a peripheral flange, with the flange being configured to snap-fit over the periphery of the mouth of the container, and a cover member having a central portion and a peripheral flange. The cover member is disposed over the base member with the central portions of the cover and base members being spaced apart and defining a cavity therebetween for receipt of a product. The cover member and the base member are releasably secured to each other so that access to the cavity can be readily accomplished.

Other objects and many of the attendant advantages of the instant invention will be readily appreciated as the same becomes better understood by reference to the following detailed description when considered in connection with the accompany drawings wherein.

Figure 1:
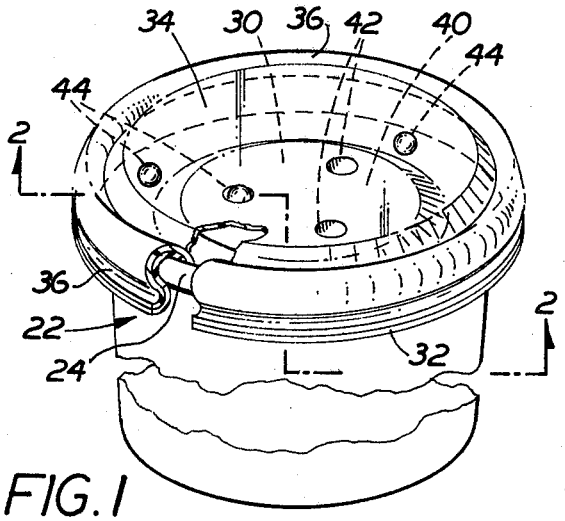
FIG. 1 is a perspective view of one embodiment of the closure of the instant invention when disposed on a typical container, such as a soft drink cup.

Referring now to the various figures of the drawing wherein like reference characters refer to like parts, there is shown at 20 in FIG. 1 a container closure in accordance with the instant invention. Closure 20 is adapted to snap-fit onto the mouth of a container, such as a conventional beverage cup 22. The container 22 includes a mouth in the form of a rolled or flanged peripheral edge 24.

In accordance with a preferred aspect of this invention the closure 20 comprises two members, a base member 26 and a cover member 28.

The base member 26 includes a central portion 30 having a flange 32 extending about the entire periphery thereof. Similarly the cover member 28 includes a domed central portion 34 having a flange 36 extending about the periphery thereof. The base member 26 and the cover member 28 are releasably secured to each other by their flanges 32 and 36, respectively. When secured together the central portion of the cover member is disposed over the central portion of the base member and is spaced therefrom to form an enclosed space or cavity 38 therebetween. The cavity 38 serves as an enclosure for a product, e.g., sugar, cream, lemon, for a premium, e.g., a coupon, a coin, jewelry, etc., for advertising material or for an amusement device, e.g., a puzzle or game.

As will be described hereinafter, the base member and the cover member, forming the closure 20, are readily separable from one another to provide immediate access to the cavity 38 and to the material disposed therein.

The closure 20 is adapted to seal the mouth of the container in a manner similar to that of conventional closures. To that end, the flanged marginal edge of the closure 20 of the instant invention is arranged to mate in a retainable snap-fitting engagement with the rolled edge 24 of the container 22 (see FIG. 1).

In accordance with a preferred aspect of this invention the base member 26 and the cover member 28 are arranged to be removed from the mouth of the container as a unit to provide free access to the interior of the container.

Figure 2:
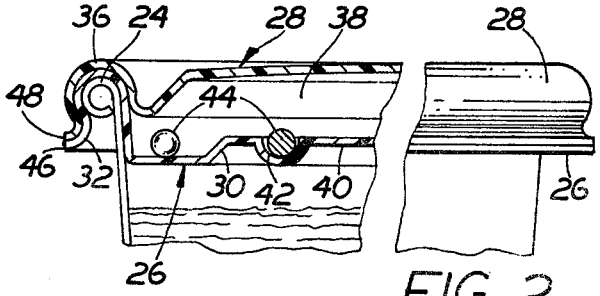
FIG. 2 is an enlarged sectional view taken along line 2—2 of FIG. 1.

In FIGS. 1 and 2 there is shown an embodiment of the closure of the instant invention wherein the closure serves as an amusement device in addition its primary function as a cover for the container. To that end, as can be seen, the central portion 30 of the base member includes a centrally located elevated pad 40. A plurality of hemispherical depressions or recesses 42 are located on the pad 40. The depressions 42 are sized to receive freely moving balls 44 disposed within the cavity 38 to form an amusement device or game of skill. It should be pointed out at this juncture that the game of skill shown in the embodiment of the closure of FIGS. 1 and 2 is but one of may types that can be provided in accordance with the instant invention. For example, a maze-like path may be provided within the cavity 38 and through which a single ball 44 is to traverse under the manual control of the user.

The relationship of the base member and the cover member to the container 22 is shown clearly in FIG. 2. As can be seen therein, the peripheral flange 32 of the base member 26 is rolled back over itself and terminates at a free marginal edge 46. In a similar manner the peripheral flange 36 of the cover member 28 is rolled back over itself and terminates in a free marginal edge 48.

In accordance with all of the embodiments of the invention shown herein, the cover member and base member are releasably secured together by the snap-fitting of the flange 36 over flange 32. It should be pointed out at this juncture, however, that the releasable securement of the cover member to the base member can be effected by other means than the snap-fitting flanges, e.g., threaded engagement between the flanges.

It should be noted that in the amusement device closure embodiment shown in FIGS. 1 and 2 the base and cover members are of the same diameter such that the free edges 46 and 48, respectively, do not extend beyond each other. This feature is useful for closures forming amusement devices or games since it inhibits entry into the interior of cavity 38.

Figure 3:
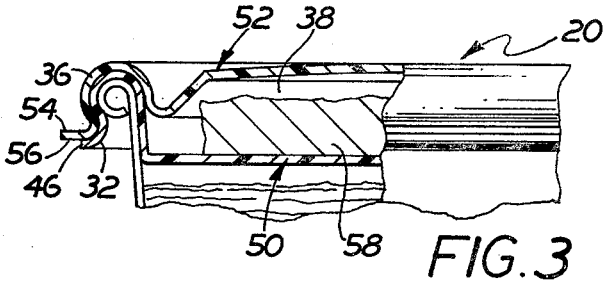
FIG. 3 is a view, similar to that of FIG. 2 but showing an alternative embodiment of the instant invention.

In FIG. 3 there is shown an alternative embodiment of a closure 20 in accordance with the instant invention. In the embodiment shown in FIG. 3 the closure serves as a product holding device in addition to its primary function as a cover for the container. As can be seen, the closure 20 comprises a base 50 constructed similarly to base member 26 but without the centrally located pad 40. To that end, the central portion of base 53 is wholly planar. The flange forming the periphery of base member 50 is constructed identically to flange 32 of base member 26 and is accordingly identified by the same reference numeral. The cover member 52, which together with base member 50 forms the closure 20 shown in FIG. 3, is constructed similarly to cover member 28 of the embodiment shown in FIGS. 1 and 2. However, the free edge of the flange 36 includes a portion 54 overlying the free edge 46 of flange 32. The overhanging portion 54 may comprise a mere tab or may be in the form of a marginal edge extending along the entire periphery of flange 36. The function of extension 54 is to provide a surface 56 upon which upward pressure can be applied to separate the cover member 52 from the base member 50 and thereby provide access to the interior cavity 36 and to the material disposed therein. In the interests of drawing simplicity the product disposed within cavity 38 is shown schematically and identified by reference numeral 58. While it is contemplated that product 58 be in the form of promotional material, such as toys, novelties, coins, jewelry, coupons, etc., food additives, such as sugar, cream, lemon, etc., advertising material or other printed matter, it is clear that the choice of products is vast and limited only by size considerations.

Figure 4:
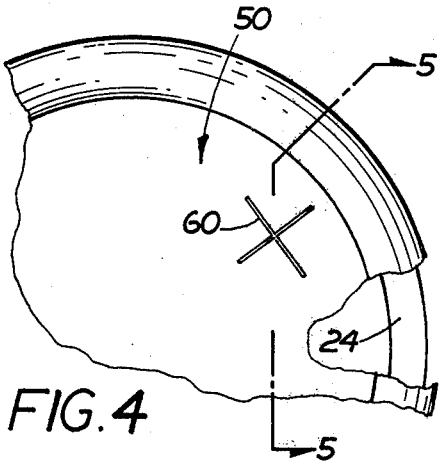
FIG. 4 is a partial top elevational view of a portion of the closure of one embodiment of the instant invention when secured to a container.
Figure 5:
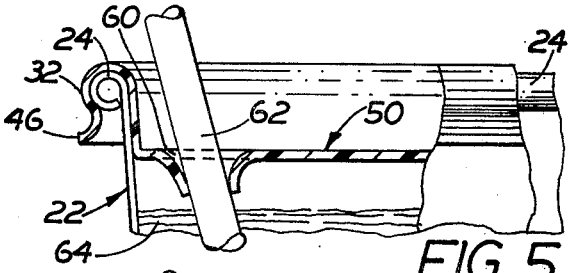
FIG. 5 is a sectional view taken along line 5—5 of FIG. 4 and showing a straw extending through the closure.

FIG. 4 is a plan view of a portion of the closure 20 shown in FIG. 3 having its cover member 52 removed and leaving the base member 50 engaged to the container rim 24. This figure illustrates how when the cover and the product 58 are removed from the closure 20, access is made available to the interior of the container 22 with the container still closed. To that end, the central portion of the base member 50 includes a pair of intersecting slits forming a cross-cut entry opening 60. The cross-cut entry opening 60 is formed in a conventional manner, such as by die-cutting. In FIG. 5 there is shown a conventional drinking straw inserted through the cross-cut 60 in the central portion of the floor of base member 50 such that the lower end of the straw extends into the body of liquid 64 held within container 22 to facilitate the drinking thereof.

It should be pointed out at this juncture that means (not shown) are also provided in the closure 20 shown in the embodiment of FIGS. 1 and 2 to enable a straw to extend therethrough to facilitate the drinking of the contents of container 22 with closure 20 in place.

Figure 7:
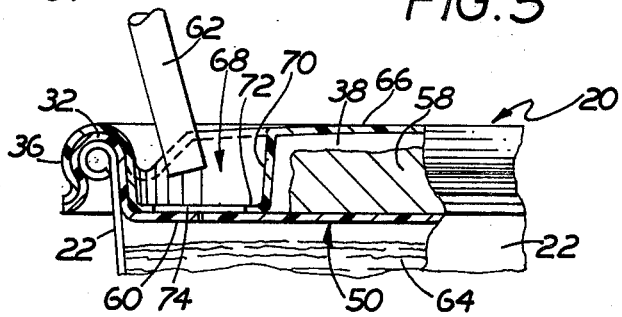
FIG. 7 is a sectional view taken along 7—7 of FIG. 6.
Figure 6:
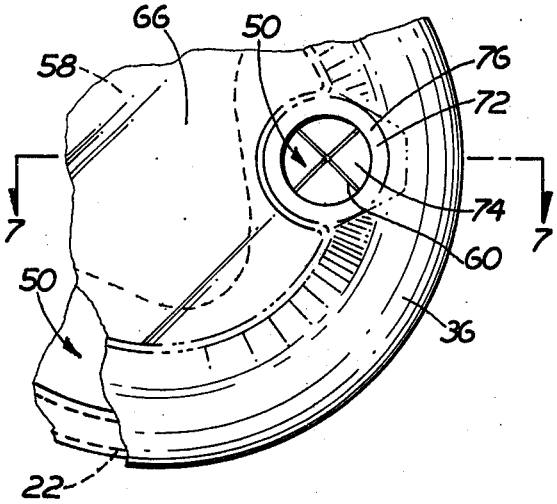
FIG. 6 is a top view, partially in section, of a portion of an alternative closure in accordance with another aspect of this invention.

In the embodiment of FIGS. 6 and 7 there is shown yet a further embodiment of the closure in accordance with this invention. In the embodiment shown therein the closure is also arranged as a product holding closure and includes means to enable the straw 52 to gain access to the contained liquid within the container 22 and without necessitating removing the cover member from the closure. To that end, as can be seen in FIG. 7, the closure 20 comprises a base member 50 constructed in a similar manner to base member 50 of the embodiment shown in FIGS. 3, 4 and 5. The cover member is identified by the reference numeral 66 and is similar in construction to cover 52 of the embodiment shown in FIGS. 3, 4 and 5 save for the inclusion of a tapered cylindrical depression 68 which is disposed within the central portion immediately adjacent to the flange 32. The depression includes an annular wall 70 and a planar wall 72. A central opening 74 is provided in the bottom wall 72. As can be seen clearly in FIG. 7, the portion of the bottom wall 72 contiguous with opening or hole 74 abuts the upper surface of the central portion of the base member 50. A cross-cut opening 60 is provided in the base member 50 and at the location immediately under hole 74 in the cover member 66. It should thus be appreciated that the straw 62 can be inserted through opening 74 in the cover member 66, through the aligned cross-cut opening 60 in the base member and into the liquid 64 within container 22. The abutment between the bottom wall 72 and the portion of the base member 50 precludes the ingress of liquid into the cavity 38 of the closure, thereby protecting the product 58 disposed therein.

Figure 8:
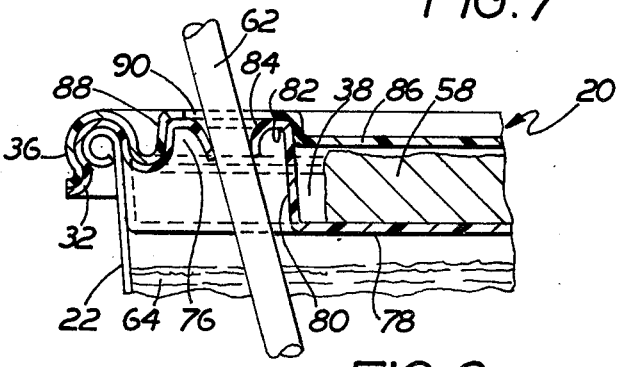
FIG. 8 is a sectional view, similar to that of FIG. 7 but showing another alternative embodiment of the closure of the instant invention.

In FIG. 8 there is shown yet a further embodiment of the closure 20 in accordance with the instant invention. In the embodiment shown in FIG. 8 the closure 20 has the same functional features as the closure of FIGS. 6 and 7. However, in lieu of the depression 68 formed in the cover member 66 a hollow projection 76 is formed in the central portion of the base member 78 of the closure 20 adjacent to peripheral flange 32. The projection includes a sloped annular wall 80 terminating in a top surface 82. The top surface 82 includes a cross-cut opening 84 therein. The cover member for the closure 20 of FIG. 8 is identified by the reference numeral 86 and includes a projecting portion 88 extending upward beyond the top surface of the cover member and closely adjacent to the peripheral flange 36. The projection 76 of the base member 78 is adapted to be received within the projection 88 in the cover member 86. As can be seen, a central hole 90 is provided in the top wall of the projection 88 and is hence aligned with the crosscut opening 84 in the base member 78. A straw 62 can then be inserted into the liquid 64 in the container 22 via the hole 90 and the aligned cross-cut opening 84. The surface contiguous with the cross-cut opening 84. The surface contiguous with the cross-cut opening 84 abuts the surface contiguous with the hole 90 to preclude the ingress of liquid into the interior space 38 in the closure, thereby protecting product 58 disposed therein.

The upward projections 76 and 88 also serve an additional function when hot liquids are held within the container 22. To that end, since the access for the straw is now at the highest point on the closure device 20 of FIG. 8, that is through the abutting surfaces at the top of the projections 76 and 88, the interior of those projections act as a trap and an escape for steam emitted from the heated liquid 64.

It should be pointed out at this juncture that in accordance with the teaching of this invention, the cover member and base member, as it may be required, can be compartmentalized both horizontally and vertically to hold a number of different products. The compartment partitions can be such as to inhibit the flow of liquid and/or powdered products from one compartment to another.

Insofar as the material for forming the closure of the instant invention are concerned, it is to be understood that the cover and base can be formed of various materials, such as plastics, paper, etc., can be either opaque or transparent or both, as applications prescribe, and can be decorated by any number of known means.

Without further elaboration, the foregoing will so fully illustrate my invention that others may, by applying current or future knowledge, readily adapt the same for use under various conditions of service.

What is claimed as the invention is:

1. A closure for a container, said container having a flanged mouth, said closure comprising a base member and a cover member releasably secured together for repeatable releasable securement as a unit on the mouth of said container, said base member having a central portion and a peripheral flange, said flange being configured to snap-fit over the flanged mouth of the container, said cover member having a central portion and a recessed peripheral flanged portion for receipt of the peripheral flange of the base member, said cover member being disposed over said base member with the central portions of said members being spaced apart and defining a cavity therebetween for receipt of an article, the releasable securement of said cover member and base member being effected by the receipt of the peripheral flange of the base member within the recessed flanged portion of the cover member, said cover member being replaceably removable from said base member to provide ready access to said cavity without removing the base member from said container, said closure including means enabling a straw to be extended therethrough and into said container, said means comprises an opening in said cover member and an aligned opening in said base member, through which aligned openings the straw can be inserted into the container when said cover member and base member are connected together, said opening in said base member comprising a cross-cut slit and wherein the opening in said cover member is a circular hole and wherein the central portion of the cover member contiguous with said hole is in the form of a disc-like depression including a flanged portion abutting the central portion of the base member contiguous with said slit.

2. A closure for a container, said container having a flanged mouth, said closure comprising a base member and a cover member releasable secured together for repeatable releasable securement as a unit on the mouth of said container, said base member having a central portion and a peripheral flange, said flange being configured to snap-fit over the flanged mouth of the container, said cover member having a central portion and a recessed peripheral flanged portion for receipt of the peripheral flange of the base member, said cover member being disposed over said base member with the central portions of said members being spaced apart and defining a cavity therebetween for receipt of an article, the releasable securement of said cover member and base member being effected by the receipt of the peripheral flange of the base member within the recessed flanged portion of the cover member, said cover member being releasably removable from said base member to provide ready access to said cavity without removing the base member from said container, said closure including means enabling a straw to be extended therethrough and into said container, said means comprises an opening in said cover member and an aligned opening in said base member, through which aligned openings the straw can be inserted into the container when said cover member and base member are connected together, said opening in said cover member comprising a cross-cut slit and wherein the opening in the base member comprises a circular hole and wherein the central portion of the base member contiguous with said hole is in the form of a disc-like projection including a flanged portion abutting the central portion of the cover member contiguous with said slit.

* * * * *